US005939355A

United States Patent [19]

Burns et al.

[11] Patent Number: 5,939,355

[45] Date of Patent: Aug. 17, 1999

[54] THERMAL DYE TRANSFER ASSEMBLAGE WITH LOW TG POLYMERIC RECEIVER MIXTURE

[75] Inventors: Elizabeth G. Burns; John DiCillo, both of Rochester, N.Y.; Matthew Wayne Johns, Lansdale, Pa.; Kristine B. Lawrence, Rochester, N.Y.

[73] Assignee: Eastman Kodak Company, Rochester, N.Y.

[21] Appl. No.: 09/047,158

[22] Filed: Mar. 24, 1998

[51] Int. Cl.[6] ..... B41M 5/035; B41M 5/38

[52] U.S. Cl. ..... 503/227; 428/195; 428/480; 428/913; 428/914

[58] Field of Search ..... 8/471; 428/195, 428/480, 913, 914; 503/227

[56] References Cited

U.S. PATENT DOCUMENTS

| | | | |
|---|---|---|---|
| 4,668,560 | 5/1987 | Kobayashi et al. | 428/195 |
| 5,534,479 | 7/1996 | Shuttleworth et al. | 503/227 |
| 5,627,128 | 5/1997 | Bowman et al. | 503/227 |

FOREIGN PATENT DOCUMENTS

| | | | |
|---|---|---|---|
| 5-238174 | 9/1993 | Japan | 503/227 |

*Primary Examiner*—Bruce H. Hess
*Attorney, Agent, or Firm*—Harold E. Cole

[57] ABSTRACT

A thermal dye transfer assemblage comprising:

(a) a dye-donor element comprising a support having thereon a dye layer comprising a dye dispersed in a polymeric binder, said dye being:

I) an electrically neutral, deprotonated, delocalized cationic dye precursor;

II) a pendant basic dye of the formula D-(L-E)$_m$ wherein D represents the residue of a dye, L represents a linking group, E represents a moiety with basic properties and m is an integer of 1–3; or III) a cationic dye precursor having the following structure:

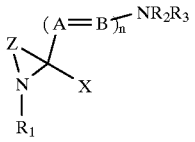

and (b) a dye-receiving element comprising a support having thereon a polymeric dye image-receiving layer, the dye-receiving element being in a superposed relationship with the dye-donor element so that the dye layer is in contact with the dye image-receiving layer, the dye image-receiving layer comprising a mixture of i) a polymer having a Tg of less than about 19° C. and having no or only slight acidity;

ii) a sulfonated polyester; and iii) a hydrated transition metal or metalloid salt of a strong acid.

14 Claims, No Drawings

THERMAL DYE TRANSFER ASSEMBLAGE WITH LOW TG POLYMERIC RECEIVER MIXTURE

CROSS REFERENCE TO RELATED APPLICATIONS

Reference is made to commonly-assigned U.S. Pat. No. 5,753,590, filed Jun. 19, 1997 entitled "Thermal Dye Transfer Assemblage With Low Tg Polymeric Receiver Mixture" by Harrison et al.; U.S. Pat. No. 5,804,531 entitled "Thermal Dye Transfer System With Polyester Ionomer Receiver" by Evans et al.; Ser. No. 09/035,709, filed Mar. 5, 1998, pending, entitled "Thermal Dye Transfer Assemblage With Low Tg Polymeric Receiver Mixture" by Bums et al. and U.S. Pat. No. 5,789,344, entitled "Thermal Dye Transfer Assemblage With Low Tg Polymeric Receiver Mixture" by Kung et al., the disclosures of which are incorporated herein by reference.

FIELD OF THE INVENTION

This invention relates to a thermal dye transfer receiver element of a thermal dye transfer assemblage and, more particularly, to a polymeric dye image-receiving layer containing a mixture of materials capable of reprotonating a deprotonated cationic dye, pendant basic dye or cationic dye precursor transferred to the receiver from a suitable donor.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to damage caused by handling, or contact with chemicals or other surfaces such as the back of other thermal prints, adhesive tape, and plastic folders such as poly(vinyl chloride), generally referred to as "retransfer".

Commonly-used dyes are nonionic in character because of the easy thermal transfer achievable with this type of compound. The dye-receiver layer usually comprises an organic polymer with polar groups to act as a mordant for the dyes transferred to it. A disadvantage of such a system is that since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

In one type of thermal dye transfer printing, deprotonated nonionic dyes may be transferred to an acid-containing receiver where a reprotonation process may take place to convert the dyes to their protonated form by interaction with the acid moiety in the dye-receiving layer. The dyes are thus rendered cationic. As a consequence, the transferred dyes are anchored in the receiving layer and form a strong electrostatic bond. The reprotonation reaction also causes a hue shift of the transferred dyes from their deprotonated form to their protonated form. In a practical sense, it is always desirable to complete this protonation (dye conversion) process as fast as possible.

DESCRIPTION OF RELATED ART

U.S. Pat. No. 4,668,560 describes the use of saturated polyesters in receiver layers that contain aluminum, magnesium, calcium and tin salts. However, metal salts are added after polymerization and are explicitly limited to organic acid salts. The polymer-salt mixtures are then cast into films from non-aqueous solvents and used as dye receiver layers for non-reactive dyes. There is a problem with this polymer-salt mixture in that it does not reprotonate a deprotonated cationic dye, pendant basic dye or cationic dye precursor transferred to the receiver from a suitable donor.

U.S. Pat. No. 5,534,479 relates to the transfer of a deprotonated cationic dye to a dye image-receiving layer containing an organic acid moiety as part of a polyester polymer which is capable of reprotonating the deprotonated cationic dye. There is no disclosure in this patent that describes the use of mixtures comprising a metal salt capable of reprotonating the deprotonated cationic dyes and a polyester polymer. In addition, there is a problem with the polymers used in this patent in that they contain strong acids which catalyze the hydrolysis of the polyester backbone which changes the properties of the polymer making it more hygroscopic and tacky.

U.S. Pat. No. 5,627,128 relates to the transfer of a deprotonated cationic dye to a polymeric dye image-receiving layer comprising a mixture of an organic polymeric or oligomeric acid which is capable of reprotonating the deprotonated cationic dye and a polymer having a Tg of less than about 19° C. and having no or only slight acidity, such as an acrylic, styrene or vinyl polymer which contains ester groups. There is a problem with this polymer mixture, however, in that such organic polymeric or oligomeric acids cause hydrolysis of such ester groups which causes physical properties of the receiver layer to change over time.

JP/05-238174 describes the thermal transfer of pendant basic dyes of the formula A-(L-B)n to receiving elements containing acidic materials. A represents the residue of a dye, L represents a covalent linking group, B represents a basic substituent and n is an integer of 1–3. The preferred acidic materials are phenols and carboxylic acids. There is a problem with the acidic receiving elements described in that they do not effectively protonate and bind thermally transferred basic dyes, as will be shown below.

It is an object of this invention to provide a receiver containing a sulfonated polyester. It is a further object of this invention that the sulfonated polyester material will reprotonate a deprotonated cationic dye transferred to it at a rate faster than what can be achieved with receiver elements containing a sulfonic acid-derived polyester.

SUMMARY OF THE INVENTION

These and other objects are achieved in accordance with this invention which relates to a thermal dye transfer assemblage comprising:

(a) a dye-donor element comprising a support having thereon a dye layer comprising a dye dispersed in a polymeric binder, the dye being:

I) an electrically neutral, deprotonated, delocalized cationic dye precursor;

II) a pendant basic dye of the formula D-(L-E)$_m$ wherein D represents the residue of a dye, L represents a linking group, E represents a moiety with basic properties and m is an integer of 1–3; or III) a cationic dye precursor having the following structure:

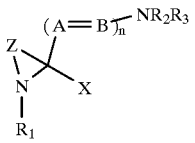

wherein:

$R_1$, $R_2$ and $R_3$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

A and B each independently represents N or CR and may be part of an aromatic or heteroaromatic ring system;

X represents —OR, —N(R)$_2$, —NRCOR, —NRSO$_2$R, —SR, —SO$_2$R, —S(O)R, —O$_2$CR, —NRCON(R)$_2$, —OCON(R)$_2$, —SO$_2$N(R)$_2$ or —NRCOOR; wherein each R independently represents H or $R_1$;

Z represents the atoms necessary to complete a 5- or 6-membered heterocyclic ring which may optionally be fused with other carbo- or heterocyclic rings;

n represents an integer of from 1–5;

X and $R_1$ may be combined to form a 5–7 membered ring; and;

$R_2$ and $R_3$ may be combined together or independently combined with A or B to form a 5–7 membered ring; and (b) a dye-receiving element comprising a support having thereon a polymeric dye image-receiving layer, the dye-receiving element being in a superposed relationship with the dye-donor element so that the dye layer is in contact with the dye image-receiving layer, the dye image-receiving layer comprising a mixture of i) a polymer having a Tg of less than about 19° C. and having no or only slight acidity;

ii) a sulfonated polyester; and iii) a hydrated transition metal or metalloid salt of a strong acid.

DESCRIPTION OF THE PREFERRED EMBODIMENTS

It was found that the sulfonated polyester in combination with a hydrated transition metal or metalloid salt of a strong acid substantially improves the dye protonation rate in comparison with receivers which do not contain this mixture.

The polymer having a Tg of less than about 19° C. employed in the invention may contain groups which are slightly acidic to improve water dispersibility. However, these acid groups are generally insufficient to protonate the dye.

As noted above, there are three different types of dyes which may be employed in the dye-donor element of the assemblage of the invention. The first type of dye is an electrically neutral, deprotonated, delocalized cationic dye precursor. In a preferred embodiment of the invention, these dyes have the following formula:

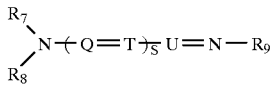

wherein:

Q, T and U form a conjugated link between nitrogen atoms selected from CH, C-alkyl, N, or a combination thereof, the conjugated link optionally forming part of an aromatic or heterocyclic ring;

$R_7$ represents H or a substituted or unsubstituted alkyl group from about 1 to about 10 carbon atoms;

$R_8$ and $R_9$ each individually represents H or a substituted or unsubstituted phenyl or a substituted or unsubstituted alkyl group from about 1 to about 10 carbon atoms; and s is 0 or an integer from 1 to 11.

Further examples of these dyes are found in U.S. Pat. Nos. 4,880,769; 5,534,478; and 5,559,076, the disclosures of which are hereby incorporated by reference. Specific examples of these dyes include the following which also have listed the absorption maxima of the deprotonated and protonated species, with the values for the latter shown in parentheses:

Dye 1

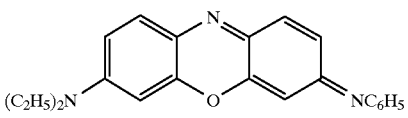

λ max 556 nm (641 nm)
magenta (cyan)

-continued

Dye 2

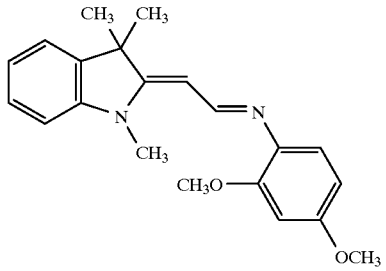

λ max 379 nm (405 nm)
yellow (yellow)

Dye 3

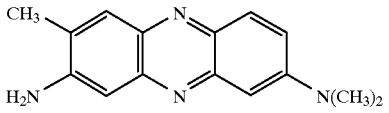

λ max 459 nm (536 nm)
yellow (magenta)

Dye 4

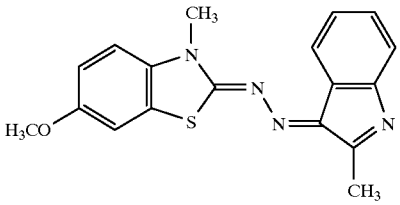

λ max 459 nm (522 nm)
yellow (magenta)

Dye 5

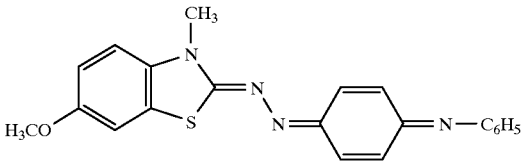

λ max 503 nm (621 nm)
red (blue)

Dye 6

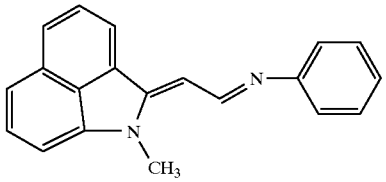

λ max 479 nm (513 nm)
yellow (magenta)

Dye 7

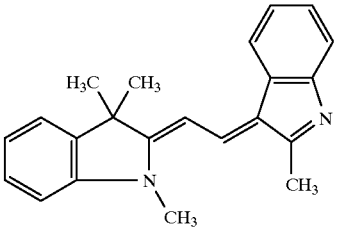

λ max 485 nm (495)
orange (orange)

-continued

Dye 8

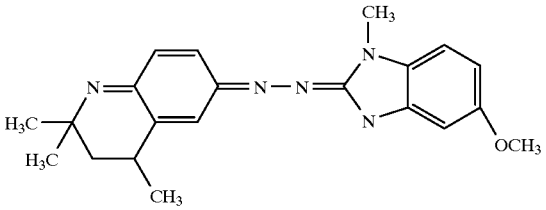

λ max 472 nm (601)
orange (blue)

Dye 9

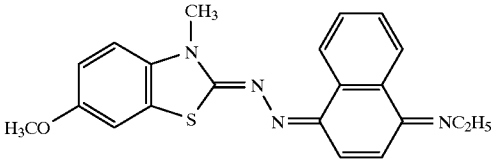

λ max 469 nm (618)
yellow (blue)

The second type of dye which may be employed in the dye-donor element of the assemblage of the invention has a pendant basic group as described above. Examples of these dyes are found in Japanese Patent Application J05/238174, the disclosure of which is hereby incorporated by reference. Specific examples of these dyes include the following:

Dye 10

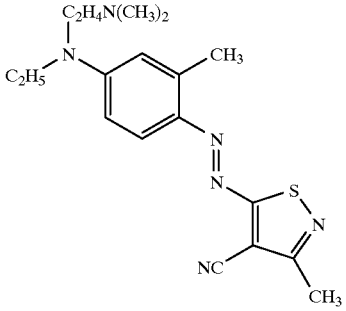

Dye 11

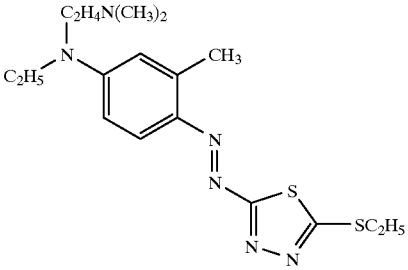

The third type of dye which may be employed in the dye-donor element of the assemblage of the invention is a cationic dye precursor as described above. In a preferred embodiment, this dye has the following formula:

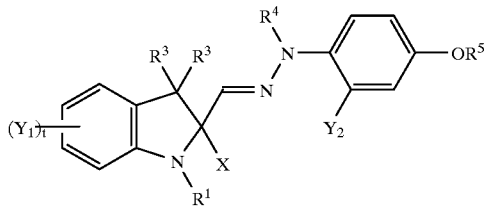

wherein:

$R^1$, $R^2$, $R^3$, $R^4$ and $R^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —$N(R)_2$, —NRCOR, —$NRSO_2R$, —SR, —$SO_2R$, —S(O)R, —$O_2CR$, —$NRCON(R)_2$, —$OCON(R)_2$, —$SO_2N(R)_2$ or —NRCOOR; wherein each R independently represents H or $R^1$;

$Y_1$ and $Y_2$ each independently represents R, halogen, CN, alkoxy, aryloxy, alkylthio, arylthio, alkoxycarbonyl, aryloxycarbonyl, acylamino, sulfonylamino, nitro, alkylsulfonyl, arylsulfonyl or thiocyano;

t represents an integer of from 1–4;

X and $R^1$ may be combined together with the atoms to which they are attached to form a 5–7 membered ring;

any two of $Y_1$ may be combined to form additional fused rings; and $R^2$ and $R^3$ may be combined together to form a 5–7 membered ring.

Specific examples of these dyes include the following:

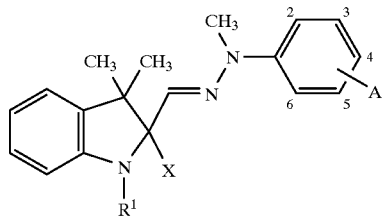

| Dye Precursor | $R^1$ | X | A | Molecular Weight | λ max (nm) (ε-max)[1] |
|---|---|---|---|---|---|
| 12 | $CH_3$ | OH | 4-$OCH_3$ | 339 | 449 (36,300) |
| 13 | —$CH_2CH_2O$— | | 4-$OC_6H_5$ | 413 | 444 (39,100) |
| 14 | —$CH_2CH_2CONH$— | | 2,4-$(OCH_3)_2$ | 408 | 426 (31,500) |
| 15 | —$CH_2CH_2CONH$— | | 4-$OCH_3$ | 378 | 455 (38,100) |
| 16 | —$CH_2CH_2O$— | | 4-$OCH_3$ | 351 | 455 (36,000) |
| 17 | —$CH_2CH(CH_2OH)O$— and —$CH_2CH(OH)CH_2O$— (mixture) | | 2,4-$(OCH_3)_2$ | 411 | 422 (29,300) |
| 18 | —$CH_2CH_2O$— | | 4-$OCH_2CONHCH_3$ | 408 | 448 (38,100) |
| 19 | —$CH_2CH(CH_2OH)O$— and —$CH_2CH(OH)CH_2O$— (mixture) | | 4-$OC_6H_5$ | 443 | 446 (38,900) |

[1]In ethanol containing HCl, ε = molar absorbtivity

Further examples of these dyes are found in copending application Ser. No. 08/996,388, filed Dec. 22, 1997, by Evans, Pyszczek and Weber, entitled Dye-Donor Element for Thermal Dye Transfer, (Docket 76728HEC).

Following are examples of low Tg polymers that may be used in the invention:

LT-1 poly(butyl acrylate-co-allyl methacrylate) 98:2 wt core/poly(glycidyl methacrylate) 10 wt shell, (Tg=−40° C.)

LT-2: poly(butyl acrylate-co-allyl methacrylate) 98:2 wt core/poly(ethyl methacrylate) 30 wt shell, (Tg=−41° C.)

LT-3: poly(butyl acrylate-co-allyl methacrylate) 98:2 wt core/poly(2-hydroxypropyl methacrylate) 10 wt shell, (Tg=−40° C.)

LT-4: poly(butyl acrylate-co-ethylene glycol dimethacrylate) 98:2 wt core/poly(glycidyl methacrylate 10 wt shell, Tg=−42° C.)

LT-5: poly(butyl acrylate-co-allyl methacrylate-co-glycidyl methacrylate) 89:2:9 wt, (Tg=−34° C.)

LT-6: poly(butyl acrylate-co-ethylene glycol dimethacrylate-co-glycidyl methacrylate) 89:2:9 wt (Tg=−28° C.)

LT-7: poly(butyl methacrylate-co-butyl acrylate-co-allyl methacrylate) 49:49:2 wt core/poly(glycidyl methacrylate) 10 wt shell, (Tg=−18° C.)

LT-8: poly(methyl methacrylate-co-butyl acrylate-co-2-hydroxyethyl methacrylate-co-2-sulfoethyl methacrylate sodium salt) 30:50:10:10 wt, (Tg=−3° C.)

LT-9: poly(methyl methacrylate-co-butyl acrylate-co-2-hydroxyethyl methacrylate-co-styrenesulfonic acid sodium salt) 40:40:10:10 wt, (Tg=0° C.)

LT-10: poly(methyl methacrylate-co-butyl acrylate-co-2-sulfoethyl methacrylate sodium salt-co-ethylene glycol dimethacrylate) 44:44:10:2 wt, (Tg=14° C.)

LT-11: poly(butyl acrylate-co-Zonyl TM®-co-2-acrylamido-2-methyl-propanesulfonic acid sodium salt) 50:45:5 wt (Tg=−39° C.) (Zonyl TM® is a monomer from the DuPont Company)

LT-12: XU31066.50 (experimental polymer based on a styrene butadiene copolymer from Dow Chemical Company) (Tg=−31° C.)

LT-13: AC540® nonionic emulsion (Allied Signal Co.) (Tg=−55° C.)

In a preferred embodiment of the invention, the sulfonated polyester is synthesized from dicarboxylates and diols and has the following formula:

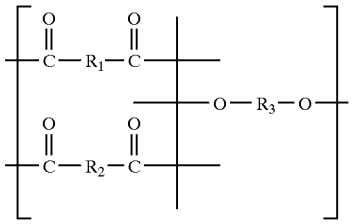

wherein $R_1$ is an aliphatic, cycloaliphatic or aromatic linkage derived from an acid, such as adipate, suberate, sebacate, cyclopentanedicarboxylate, cyclohexandicarboxylate, isophthalate or terephthalate; and comprises from 0 to 30 mole percent of the polymer;

$R_2$ is a sulphonated linkage derived from an acid, such as 5-sulphoisophthalate, 5-sulpho-1,3-cyclohexanedicarboxylate or sulfosuccinate; and comprises from 20 to 50 mole percent of the polyester; and $R_3$ is an aliphatic, fatty acid dimer, cycloaliphatic, glycolic, or polymeric linkage derived from prepolymer diols, such as ethyleneglycol, propanediol, hexanediol, decanediol; a fatty acid dimer diol such as Pripol 2203®, cyclohexanedimethanol, tricyclodecanedimethanol, diethylene glycol, hexaethylene glycol, propylene glycol, tripropylene glycol, polyethylene glycol, or polypropylene glycol; and comprises 50 mole percent of the polyester.

The sulfonated polyester may be present in the dye image-receiving layer in any amount which is effective for its intended purpose. In general, good results have been obtained at a polymer concentration of from about 0.5 to about 10 g/m$^2$. The polymers may be coated from organic solvents or water, if desired.

The hydrated transition metal or metalloid salt of a strong acid useful in the invention include various hydrated forms of the following transition metal or metalloid salts: aluminum sulfate, aluminum nitrate, aluminum chloride, potassium aluminum sulfate (alum), zinc sulfate, zinc nitrate, zinc chloride, nickel sulfate, nickel nitrate, nickel chloride, ferric sulfate, ferric chloride, ferric nitrate, cupric sulfate, cupric chloride, cupric nitrate, antimony (III) chloride, cobalt (II) chloride, ferrous sulfate, stannic chloride, aluminum trichloroacetate, zinc bromide, aluminum tosylate, zirconium (IV) chloride, etc. Mixtures of the above salts and complex salts thereof may also be used. In a preferred embodiment of the invention, the following hydrated transition metal and metalloid salts of a strong acid may be used, with aluminum sulfate being especially preferred:

MS-1: $Al_2(SO_4)_3.18H_2O$

MS-2: $AlK(SO_4)_2.12H_2O$

MS-3: $NiSO_4.6H_2O$

MS-4: $ZnSO_4.7H_2O$

MS-5: $CuSO_4.5H_2O$

MS-6: $Fe_2(SO_4)_3.4H_2O$

MS-7: $Al(NO_3)_3.9H_2O$

MS-8: $Ni(NO_3)_2.6H_2O$

MS-9: $Zn(NO_3)_2.6H_2O$

MS-10: $Fe(NO_3)_3.9H_2O$

MS-11: $AlCl_3.6H_2O$

Any amount of hydrated transition metal or metalloid salt of a strong acid can be used in the receiver as long as it is sufficient to fully protonate the dyes transferred to the receiver. In general, good results have been obtained when the hydrated transition metal or metalloid salt of a strong acid is employed at a concentration of from about 0.05 to about 1.5 g/m$^2$, preferably from about 0.1 to about 0.8 g/m$^2$.

Polymeric surfactants comprising a hydrophobic component containing an aryl radical containing at least 7 carbon atoms and a hydrophilic block component containing at least six repeat units derived from water-soluble monomers, and multifunctional block copolymeric surfactants derived from the sequential addition of propylene oxide or higher alkylene oxide units and subsequently ethylene oxide units to a polyamine moiety, have been found to be particularly effective for stabilizing aqueous dispersions of polyester polymers with added hydrated transition metal or metalloid salts of a strong acids as described in copending, commonly assigned, concurrently filed U.S. Ser. No. 08/995,806, the disclosure of which is incorporated by reference herein.

The general classes of polymeric surfactants for use in accordance with preferred embodiments of the invention are water-soluble or water-dispersible polymers. Preferably, such surfactants have an HLB number of at least 8, more preferably at least about 11, and most preferably at least about 14. The HLB number of a surfactant is a measure of the hydrophilic/lipophilic balance of the compound and can be determined as described in "Polymeric Surfactants," Surfactant Science Series, volume 42, page 221, by I. Pirma.

Preferred polymeric surfactants for use in accordance with one embodiment of the invention comprise a hydrophilic component containing at least six repeat units (preferably from 8 to about 100 repeat units, more preferably at least 10 repeat units, and most preferably at least 14 repeat units) derived from water-soluble monomers, and a hydrophobic component containing a substituted aryl radical containing at least 7 carbon atoms (preferably 12 to 30 carbon atoms, and more preferably 14 to 18 carbon atoms). The hydrophilic component preferably comprises a poly (ethylene oxide) unit, but can be any other water-soluble unit, such as polyethyloxazoline, poly(vinyl alcohol), poly (vinyl pyrrolidone), poly(glycidol) or the like. Particularly preferred surfactants comprise aryl polyoxyethylene ether surfactants represented by Formula I:

I

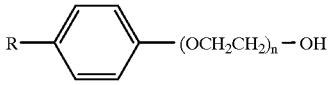

where R is an aryl, alkyl or aralkyl group having from 1 to about 20 carbon atoms, more preferably 6 to 16 carbon atoms, and n has an average value greater than or equal to 10, preferably from about 14 to about 100.

Examples of preferred surfactants according to Formula I and similar compounds include the following:

| Surfactant | Trade Name (Manufacturer) | R | n | HLB |
|---|---|---|---|---|
| D-1 | Triton X-165 ® (Union Carbide Co.) | octylphenol | 16 | 15.8 |
| D-2 | Triton X-305 ® (Union Carbide) | octylphenol | 30 | 17.3 |
| D-3 | Triton X-405 ® (Union Carbide Co.) | octylphenol | 40 | 17.7 |
| D-4 | Triton X-705 ® (Union Carbide Co.) | octylphenol | 70 | 18.7 |
| D-5 | Syn Fac 8216 ® (Milliken Chemical Co.) | bisphenol A based arylphenol | 10–25 | 15 |
| D-6 | Syn Fac 334-13 ® (Milliken Chemical Co.) | bisphenol A based arylphenol | 10–25 | 13 |
| D-7 | Olin 10G (Olin Chemical Co.) | para-nonylphenol | 8–10* | 15.4 |

*glycidol units rather than ethylene oxide units

Polymeric surfactants for use in accordance with a second preferred embodiment of the invention comprise polyethylene oxide and polypropylene oxide (or higher alkylene oxide) units linked through a polyamine group, such as an ethylene diamine or tetramethylene diamine group. Particularly preferred surfactants in accordance with such embodiment are as indicated in Formula II:

II

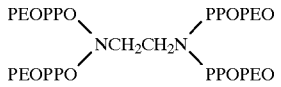

wherein PEO is poly(ethylene oxide) and PPO is poly (propylene oxide). The molecular weight of this material is preferably greater than about 5,000.

Specific examples of the above block copolymeric surfactants of Formula II which may be used in the invention include the following:

| Surfactant | Trade Name | Manufacturer | MW | HLB |
|---|---|---|---|---|
| D-8 | Tetronic ® 1107 | BASF Corp. | 15000 | 24 |
| D-9 | Tetronic ® 1307 | BASF Corp. | 18000 | 24 |
| D-10 | Tetronic ® 904 | BASF Corp. | 6700 | 15 |
| D-11 | Tetronic ® 704 | BASF Corp. | 5500 | 15 |
| D-12 | Tetrornic ® 908 | BASF Corp. | 25000 | 31 |

Generally, polymeric surfactants useful in preferred embodiments of the present invention are well known in the art and many of them are commercially available as indicated above. Typically the surfactant comprises water-soluble or dispersible polymers either linear or branched. Preferred surfactants comprise various poly(ethylene oxide) block containing polymers. The preferred surfactants are amphipathic in nature. Such a surfactant comprises in its molecule an oleophilic group of sufficient length to adsorb firmly to the surface of the dispersed polymer particles and also comprises a hydrophilic group of sufficient length to provide a large enough steric barrier to interparticle attraction. The hydrophilic segment may or may not comprise ionic groups and the oleophilic segment may or may not comprise polarizable groups. Ionic groups, if present, in the hydrophilic segment of the polymer provide added colloidal stabilization through ionic repulsion between the dispersed particles of the polymer. The polarizable groups, if present, in the oleophilic segment of the polymer further enhance association of the surfactant with dispersed hydrophobic polymers.

Any amount of aromatic polyether surfactant or block copolymeric surfactant can be used in the receiving element employed in the invention as long as enough is present to stabilize the polyester dispersion in the presence of the hydrated transition metal or metalloid salt of a strong acid. In general, good results have been obtained when these materials are employed at a concentration of from about 0.10 to about 2.15 $g/m^2$, preferably from about 0.5 to about 1.6 $g/m^2$.

The support for the dye-receiving element employed in the invention may be transparent or reflective, and may comprise a polymeric, synthetic or cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 $\mu$m to 1000 $\mu$m. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Any material can be used as the support for the dye-donor element employed in the invention, provided it is dimensionally stable and can withstand the heat of the thermal print heads. Such materials include polyesters such as poly (ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 $\mu$m.

Dye-donor elements that are used with the dye-receiving element of the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly(vinyl acetal) such as poly(vinyl alcohol-co-butyral). The binder may be used at a coverage of from about 0.1 to about 5 g/m$^2$.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of deprotonated dyes, as described above, capable of generating a cyan, magenta and yellow dye and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2OO8-F3. Alternatively, other known sources of energy for thermal dye transfer may be used, such as lasers as described in, for example, GB No. 2,083,726A.

When a three-color image is to be obtained, the assemblage described above is formed on three occasions during the time when heat is applied by the thermal print head. After the first dye is transferred, the elements are peeled apart. A second dye-donor element (or another area of the donor element with a different dye area) is then brought into register with the dye-receiving element and the process repeated. The third color is obtained in the same manner. After thermal dye transfer, the dye image-receiving layer contains a thermally-transferred dye image.

The following examples are provided to further illustrate the invention.

EXAMPLES

Example 1

Synthesis of Sulfonated monomers.

Synthesis of dimethylsulfosuccinic acid, sodium salt

A 70% solution in water of sulfosuccinic acid from Aldrich was used; 250 g, 0.88 moles of the acid was taken up in 1 L of methanol. The mixture was heated overnight at 65° C. After cooling to room temperature 35.2 g, 0.88 moles of sodium hydroxide dissolved in 70 ml of water was added dropwise over two hours. During the addition, a white precipitate formed which was filtered upon completion of the addition and 90 grams of the solid was collected. Proton NMR in deuterium oxide and mass spectroscopy confirms the structure of this material. A second crop of the material was obtained (79 grams) by removing the solvents in the filtrate and recrystallizing the resulting solid with hot isopropanol.

The synthesis of dimethyl-5-sulpho-1,3-cyclohexanedicarboxylate, sodium salt, was carried out in an analogous manner, from 5-sulpho-1,3-cyclohexanedicarboxylate, monosodium salt.

Example 2

Synthesis of P-1

0.15 moles sodium dimethyl-5-sulfoisophthalate (44.2 g), 0.35 moles dimethylisophthalate (68.02 g) and 0.50 moles diethylene glycol, 0.25 moles decanediol were weighed into a 250 mL round-bottom, long-necked flask. A take-off arm was attached to the top of the flask. Under a nitrogen stream, the monomers were first melted at 200° C., then the molten monomers were purged with nitrogen. Antimony pentoxide, 0.5 mL of a 6% dispersion in ethylene glycol was added. Five drops of neat titanium isopropoxide were added, and the resulting methanol distillate was collected. After two hours, the temperature was increased to 250° C., a vacuum manifold and a stir paddle were attached to the flask, and vacuum applied with stirring. The reaction continued for two hours under vacuum. The flask was then allowed to cool to room temperature for 30 minutes, before the vacuum was released. Polymers were isolated by freezing the flasks in liquid nitrogen and breaking the flask. The resultant polymer had a Tg of 41° C.

The synthesis of Polymers P-2 through P-14 were carried out in the same way as the synthesis of P-1 except that monomers indicated in Table 1 were used, and when no isophthalic acid groups were present, the entire reaction was carried out at 250° C.

TABLE 1

| Polymer | Composition | Tg (° C.) |
|---|---|---|
| P-1 | 15 mole % sodium sulfoisophthalic acid<br>35 mole % isophthalic acid<br>50 mole % diethylene glycol | 41 |
| P-2 | 25 mole % sodium 5-suphoisophthalic acid<br>25 mole % dimethylcyclohexanedicarboxylate<br>25 mole % cyclohexanedimethanol<br>25 mole % decanediol | 120 |
| P-3 | 20 mole % sodium sulfoisophthalic acid<br>30 mole % sebacic acid<br>10 mole % diethyleneglycol<br>40 mole % 1,4-cyclohexanedimethanol | NF* |
| P-4 | 25 mole % sodium sulfoisophthalic acid<br>25 mole % sulfoisophalic acid<br>40 mole % diethyleneglycol<br>10 mole % decanediol | 41 |
| P-5 | 45 mole % sodium sulfoisophthalic acid<br>5 mole % isophthalic acid<br>20 mole % diethyleneglycol<br>30 mole % 1,4-cyclohexanedimethanol | 41 |
| P-6 | 35 mole % sodium sulfoisophthalic acid<br>15 mole % isophthalic acid<br>30 mole % diethylene glycol<br>10 mole % decanediol<br>10 mole % 1,4-cyclohexanedicarboxylate | NF* |
| P-7 | 20 mole % sodium sulfoisophthalic acid | −23 |

TABLE 1-continued

| Polymer | Composition | Tg (° C.) |
|---|---|---|
| | 30 mole % 1,4-cyclohexanedicarboylic acid<br>50 mole % decanediol | |
| P-8 | 30 mole % sodium sulfoisophthalic acid<br>20 mole % 1,4-cyclohexanedicarboxylic acid<br>10 mole % diethylentheneglycol<br>40 mole % 1,4-cyclohexanedimethanol | NF* |
| P-9 | 50 mole % sodium sulfoisophthalic acid<br>30 mole % decanediol<br>20 mole % 1,4-cyclohexanedimethanol | 180 |
| P-10 | 30 mole % sodium sulfoisophthalic acid<br>20 mole % sebacic acid<br>40 mole % diethyleneglycol<br>10 mole % decanediol | 38 |
| P-11 | 25 mole % sodium sulfosuccinic acid<br>25 mole % isophthalic acid<br>25 mole % diethyleneglycol<br>25 mole % decanediol | −12 |
| P-12 | 40 mole % sodium sulfoisophthalic acid<br>10 mole % sebacic acid<br>25 mole % decanediol<br>25 mole % 1,4-cyclohexanedimethanol | 40 |
| P-13 | 40 mole % sodium sulfoisophthalic acid<br>10 mole % 1,4-cyclohexanedicarboxylate<br>10 mole % diethyleneglycol<br>30 mole % decanediol<br>10 mole % 1,4-cyclohexanedimethanol | 158 |
| P-14 | 25 mole % sodium 5-sulpho-1,3-cyclohexane dicarboxylate<br>25 mole % dimethylcyclohexanedicarboxylate<br>25 mole % cyclohexanedimethanol<br>25 mole % decanediol | 98 |

*Tg was not found using differential scanning colorimetry

Control polyester CP-1 is, poly[isophthalic acid-co-5-sulfoisophthalic acid (90:10 molar ratio)-diethylene glycol (100 molar ratio), (sulfonic acid of AQ29D, Eastman Chemical Company).

A control polyester, CP-2, was made in the same way as the polymers in Table 1, except that it has the composition 8 mole % sodium sulfoisophthalate, 42 mole % 1,4-cyclohexanedicarboxylate, 50 mole % 1,4-cyclohexanedimethanol.

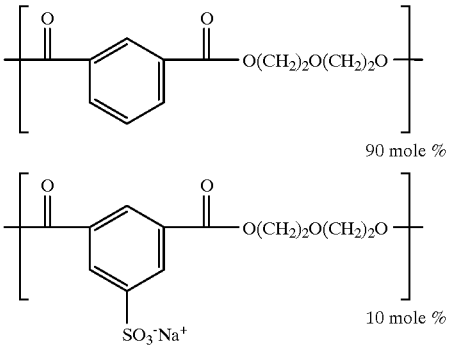

Example 3

Synthesis of a low Tg polymer, LT-1, Poly(butyl acrylate-co-allyl methacrylate) 98:2 wt core/poly (glycidylmethacrylate) 10 wt shell.

To a 12 L 3-neck flask fitted with a stirrer and condenser were added 2400 mL degassed distilled water, 26.8 mL 45% Dowfax® 2A1 surfactant (Dow chemical) and 8 g sodium carbonate. The flask was heated to 80° C. Subsequently, 4,4'-azobis(4-cyanovaleric acid) (16 g 75% aqueous solution) was added followed by the contents from an addition flask containing 2400 mL degassed distilled water, 26.8 mL 45% Dowfax® 2A1 surfactant, 1176 g butyl acrylate and 24 g allyl methacrylate over a period of two hours. The pH of the resulting polymer was adjusted to 7 with 10% acetic acid solution, and it was stirred at 80° C. for one hour. Subsequently, 4,4'-azobis(4-cyanovaleric acid) (0.6 g 75% aqueous solution) was added followed by the contents from an addition flask containing 480 mL degassed distilled water, 18 mL 45% Dowfax® 2A1 surfactant, 120 g allyl methacrylate over a period of 90 min. The resulting polymer was stirred at 80° C. for 2 hours and then cooled to 25° C. The pH was adjusted to 7 with sodium carbonate. The low Tg polymer contained 19.9% solids and had a particle size of 92.8 nm and a Tg of −40° C.

Example 4

Preparation of Receiver Elements

Control Receiver Element C-1:

The element was prepared by first extrusion-laminating a paper core with a 38 micron thick microvoided composite film (OPPalyte® 350TW, Mobil Chemical Co.) as disclosed in U.S. Pat. No. 5,244,861. The composite film side of the resulting laminate was then coated with the following layers in the order recited:

1) a subbing layer of Prosil® 221 (0.05 g/m$^2$) and Prosil® 2210 (0.05 g/m$^2$) (PCR, Inc.) coated from 3A alcohol; and 2) a dye image-receiving layer which was a mixture of 2.69 g/m$^2$ of the polyester CP-1, (sulfonic acid of AQ29, Eastman Chemical Company), 4.04 g/m$^2$ of LT-1 and 0.022 g/m$^2$ of a fluorocarbon surfactant (Fluorad® FC-170, 3M Corporation), coated from distilled water. This composition was analogous to Receiver Elements 7 through 18 in Example 1 of U.S. Pat. No. 5,627,128.

Control Receiver Element C-2

This element was prepared in the same manner as Control Receiver Element C-1 except the subbing layer was 0.02 g/m$^2$ Polymin P® polyethylene-imine (BASF) coated from distilled water and the dye receiving layer was a mixture of 1.24 g/m$^2$ of CP-2, 3.82 g/m$^2$ of LT-1, 0.59 g/m$^2$ of MS-1 ($Al_2(SO_4)_3.18H_2O$), and 1.1 g/m$^2$ of SynFac 8216® (Milliken Chemicals), coated from distilled water.

Control Receiver Element C-3

This element was prepared in the same manner as Control Receiver Element C-2 except polymer CP-3 was used in place of CP-2.

Receiver Elements E-1 through E-14 of the Invention:

Receiver Elements E-1 through E-14 were prepared as described above for Control Receiver Element C-2 except polymers P-1 through P-14 were used in place of CP-2. A summary of the receiver and control receiver elements can be found in the following table:

TABLE 2

| Receiver Element | Polymer |
|---|---|
| E-1 | P-1 |
| E-2 | P-2 |
| E-3 | P-3 |
| E-4 | P-4 |
| E-5 | P-5 |
| E-6 | P-6 |
| E-7 | P-7 |
| E-8 | P-8 |
| E-9 | P-9 |
| E-10 | P-10 |

TABLE 2-continued

| Receiver Element | Polymer |
|---|---|
| E-11 | P-11 |
| E-12 | P-12 |
| E-13 | P-13 |
| E-14 | P-14 |
| C-1 | CP-1 |
| C-2 | CP-2 |
| C-3 | CP-3 |

Example 5

Dye-Donor Elements

Individual dye-donor elements were prepared by coating the following compositions in the order listed on a 6 μm poly(ethylene terephthalate) support:

1) a subbing layer of Tyzor TBT®, a titanium tetrabutoxide, (DuPont Company) (0.16 g/m$^2$) coated from 1-butanol; and 2) an imaging dye layer coated from a tetrahydrofuran/cyclopentanone (95/5) solvent mixture, whereby two different binder polymer mixtures were used with the selected dye as shown in Table 3 below:

DB-1 propionate ester of bisphenol A copolymer with epichlorohydrin (prepared by techniques similar to those described in U.S. Pat. No. 5,244,862);

DB-2 poly(butyl methacrylate-co-Zonyl TM®) (75/25) where Zonyl TM® is a perfluoro monomer available from DuPont.

Details of dye and binder laydowns are summarized in the following Table 3:

TABLE 3

| Dye Donor Element | Deprotonated Dye | Dye Laydown (g/m$^2$) | DB-1 Laydown (g/m$^2$) | DB-2 Laydown (g/m$^2$) |
|---|---|---|---|---|
| 1 | Dye 2 | 0.28 | 0.29 | 0.05 |
| 2 | Dye 1 | 0.15 | 0.19 | 0.03 |

On the back side of the dye-donor element were coated the following compositions in the order listed:

1) a subbing layer of Tyzor TBT®, a titanium tetrabutoxide, (DuPont Company) (0.16 g/m$^2$) coated from 1-butanol; and 2) a slipping layer of 0.38 g/m$^2$ poly(vinyl acetal) (Sekisui), 0.022 g/m$^2$ Candelilla wax dispersion (7% in methanol), 0.011 g/m$^2$ PS513 amino-terminated polydimethylsiloxane (Huls) and 0.0003 g/m$^2$ p-toluenesulfonic acid coated from a 3-pentanone/distilled water (98/2) solvent mixture.

Example 6

Evaluation of Thermal Dye Transfer Images

Eleven-step sensitometric green (cyan+yellow) thermal dye transfer images were prepared from the above Dye Donor Elements 1 and 2 and dye-receiver elements. The dye side of the dye-donor element approximately 10 cm×15 cm in area was placed in contact with a receiving-layer side of a dye-receiving element of the same area. This assemblage was clamped to a stepper motor-driven, 60 mm diameter rubber roller. A thermal head (TDK No. 8I0625 with a resolution of 5.4 dots/mm, thermostatted at 25° C.) was pressed with a force of 24.4 Newton (2.5 kg) against the dye donor element side of the assemblage, pushing it against the rubber roller.

The imaging electronics were activated causing the donor-receiver assemblage to be drawn through the print head/roller nip at 40.3 mm/sec. Coincidentally, the resistive elements in the thermal print head were pulsed for 127.75 μs/pulse at 130.75 μs intervals during a 4.575 msec/dot printing cycle (including a 0.391 msec/dot cool-down interval). A stepped image density was generated by incrementally increasing the number of pulses/dot from a minimum of 0 to a maximum of 32 pulses/dot. The voltage supplied to the thermal head was approximately 12.5 v resulting in an instantaneous peak power of 0.294 watts/dot and a maximum total energy of 1.20 mJ/dot. This procedure was done using the yellow dye-donor element 1 and then repeated on a portion of the yellow image with the cyan donor element 2 to produce a green stepped image. Print room humidity: 32% RH.

For images containing a cyan dye (cyan or green images), protonation causes a color change from the deprotonated dye form (magenta) to the protonated dye form (cyan). This color change can be monitored by measuring status A red (cyan) and green (magenta) densities at various time intervals and calculating the red/green ratio as a function of time.

After printing, the dye-donor element was separated from the imaged receiving element and the Status A reflection red and green densities at step 10 in the stepped-image were measured for the cyan image using an X-Rite 820® Reflection Densitometer (X-Rite Corp.) after 5 minutes at room temperature. The prints were then placed in a 50° C./50% RH oven for 3.0 hours (incubation) and the red and green densities were reread. A red/green (R/G) ratio (minus the baseline) was calculated for the cyan image in each receiver after 5 minutes and after 3.0 hours of incubation and the % dye conversion for the cyan dye in the green image was calculated assuming the incubated R/G ratios represented 100% dye conversion. Complete dye conversion (dye reprotonation) of the cyan dye in the cyan image occurs when the red/green ratio after incubation is greater than 2.0. The results are summarized in the following table:

TABLE 4

| Receiver Element | R/G Ratio 5 Min.[1] | R/G Ratio 3 Hours, inc.[2] | Dye Conversion, 5 Min.[3] |
|---|---|---|---|
| E-1 | 2.5 | 5.7 | 44% |
| E-2 | 2.5 | 5.4 | 46% |
| E-3 | 2.5 | 5.2 | 48% |
| E-4 | 2.7 | 5.5 | 49% |
| E-5 | 3.1 | 5.6 | 55% |
| E-6 | 3.2 | 5.6 | 57% |
| E-7 | 2.8 | 4.9 | 57% |
| E-8 | 3.0 | 5.2 | 58% |
| E-9 | 3.5 | 5.7 | 61% |
| E-10 | 3.3 | 5.3 | 62% |
| E-11 | 3.2 | 5.1 | 63% |
| E-12 | 3.6 | 5.4 | 67% |
| E-13 | 3.9 | 5.5 | 71% |
| E-14 | 3.5 | 4.6 | 76% |
| C-1 | 1.9 | 5.8 | 33% |
| C-2 | 1.5 | 4.8 | 31% |
| C-3 | 1.8 | 4.5 | 40% |

[1]calculated red/green ratio for green image after 5 minutes at room temperature

[2]calculated red/green ratio for green image after 3 Hours at 50° C./50% RH

[3](R/G Ratio, 5 min r.t.)/(R/G Ratio, 3 Hrs., inc) × 100 for green image

The above results show that receiver element s containing highly sulfonated polyesters employed in the invention mixed with a hydrated transition metal or metalloid salt of a strong acid, and a polymer having a Tg less than 19° C. and being of no or slight acidity E-1 through E-14) improved the rate of protonation (dye conversion) of deprotonated cationic dyes after printing relative to the control receiver element containing a mixture of a polymeric sulfonic acid and a polymer having a Tg less than about 19° C. and being of no or slight acidity (C-1) or control receiver elements containing a mixture of polyesters containing lower levels of sulfonation (CP-2 and CP-3) mixed with a hydrated transition metal or metalloid salt of a strong acid (C-2 through C-3).

Example 7

Donor and Receiver Elements

Control Receiver Element C-4:

This receiving element was prepared as described above for Receiver Elements 1 through 6 in Example 4 except the dye-receiving layer was 7.23 g/m$^2$ of Vylon 200® (Toyobo Co., Ltd.), a polyester similar to Vylon 280®, described in JP/05-238174, Example 1, 0.72 g/m$^2$ of trichlorophenol (acidic substance I-12 of JP/05-238174, pKa=6.0) and 0.66 g/m$^2$ polyisocyanate (Desmodour N3300®, Mobay Corp.) coated from toluene, MEK and cyclohexanone (46/46/8). This receiving element is essentially the same as described in Example 1 of JP/05-238174.

Dye Donor Element 3: This was the same as the dye donor elements described in Example 5 above except the dye layer was 0.20 g/m$^2$ of Dye 10, a mixture of cellulose acetate propionate 482-5 and 482-20 (0.11 gm$^2$ each) (Eastman Chemical Company), 0.06 g/m$^2$ of poly(butyl methacrylate-co-Zonyl TM®) 75:25, where Zonyl TM is a fluorinated acrylate monomer (DuPont Chemical Co.), 0.02 g/m$^2$ of Paraplex G25® (a polyester sebacate, C.P. Hall Company) and 0.01 g/m$^2$ of 2,4,6-trimethylanilide of phenyl-indandiacid (TMA) coated from a mixture of toluene/methanol/cyclohexanone (70/25/5).

Dye-Donor Element 4: This was the same as Dye Donor Element 3 except the subbing layer contained 0.04 g/m$^2$ Polymin P® polyethyleneimine (BASF Corp.) and 0.01 g/m$^2$ of poly(butyl acrylate-co-allyl methacrylate) (98:2) 70 wt. core/poly(glycidyl methacrylate) 30 wt. shell, coated from water; and the dye layer contained 0.33 g/m$^2$ of Dye 13, 0.49 g/m$^2$ poly(vinyl butyral) (Butvar B76®, Monsanto Company), 0.16 g/m$^2$ of poly(butyl methacrylate-co-Zonyl TM®) 75:25 and 0.005 g/m$^2$ FC-431® (fluorocarbon surfactant (3M Company) coated from a toluene/n-propanol/cyclohexanone (65/30/5) solution.

Example 8

Evaluation of Thermal Dye Transfer Images Generated in Example 7

Evaluation was the same as described in Example 6 above except the print voltage was 13.0 volts resulting in an instantaneous peak power of 0.318 watts/dot and a maximum total energy of 1.30 mJ/dot. This procedure used yellow dye-donor element 4 and magenta dye-donor element 3 to produce yellow and magenta stepped images. Print room humidity: 30% RH.

After printing, the imaged receiving element was separated from the donor element and placed into an oven at 50° C./50% RH for 3 hours to ensure that the dye was evenly distributed throughout the receiving layer. After incubation, the appropriate Status A reflection densities (green or blue) of each of the eleven steps were measured using an X-Rite 820® reflection densitometer and the density values measured at step 11 (D-max, a measure of the efficiency of dye transfer) for each combination are listed in Tables 5 and 6. The effectiveness of binding pendant basic dyes like Dye 3 or cationic dye precursors (Dye 4) to the receiving elements of the invention was determined by placing the imaged side of the stepped image in intimate contact with a similarly sized piece of a plasticized poly(vinyl chloride), (PVC) report cover, a 1 Kg weight was placed on top and the whole assemblage was incubated in an oven at 50° C. for 1 week. The PVC sheet was separated from the stepped image and the Status A green transmission density in the PVC (a measure of the amount of unwanted dye migration into the PVC) corresponding to the maximum density step of the original stepped image was measured with an X-Rite 820® reflection densitometer. The retransfer densities for each dye-donor:dye receiver combination are listed in Tables 5 and 6. Low numbers indicate effective binding of the dye to the receiving elements.

The retransfer densities for Dye 4 (Table 6) are unreliable because the unprotonated (unbound) dye is nearly colorless. For this dye, the degree of protonation was determined by suspending the imaged receiver. elements in a closed vessel containing concentrated hydrochloric acid (HCl) for 1.0 minute. The Status A blue densities of the stepped images were reread as above and the % increase in density at D-max is listed in Table 6. Higher numbers reflect less protonated dye in the original (unfumed) receiving element whereas a low % increase indicated more effective protonation/binding of the transferred dye in the receiving element.

TABLE 5

Data for Dye-Donor Element 3

| Receiver Element | Maximum Reflection Density (Status A Green) | Retransfer Density (Status A Green) |
|---|---|---|
| E-1 | 2.8 | 0.02 |
| E-2 | 2.8 | 0.06 |
| E-3 | 2.7 | 0.04 |
| E-4 | 2.8 | 0.01 |
| E-5 | 2.3 | 0.03 |
| E-6 | 2.9 | 0.03 |
| E-8 | 2.6 | 0.02 |
| E-9 | 2.6 | 0.02 |
| E-10 | 2.8 | 0.02 |
| E-11 | 2.9 | 0.03 |
| E-12 | 2.6 | 0.03 |
| E-13 | 2.9 | 0.02 |
| E-14 | 2.9 | 0.02 |
| C-4 | 1.4 | 0.30 |

TABLE 6

Data for Dye-Donor Element 4

| Receiver Element | Maximum Reflection Density (Status A) | Retransfer Density (Status A Blue) | % Change in Density after Fuming with HCL (Status A Blue) |
|---|---|---|---|
| E-1 | 2.0 | 0.01 | 3 |
| E-2 | 2.0 | 0.01 | 1 |
| E-3 | 2.1 | 0.04 | 2 |
| E-4 | 2.0 | 0.02 | 1 |
| E-5 | 2.0 | 0.07 | 2 |
| E-6 | 2.0 | 0.03 | 0 |
| E-8 | 2.0 | 0.07 | 0 |
| E-9 | 1.9 | 0.03 | 1 |
| E-10 | 2.1 | 0.04 | 5 |
| E-11 | 2.1 | 0.01 | 8 |
| E-12 | 1.9 | 0.06 | 1 |
| E-13 | 2.1 | 0.02 | 2 |
| E-14 | 2.0 | 0.01 | 4 |
| C-4 | 0.30 | 0.01 | 300 |

The above data show that the receiver elements containing highly sulfonated polyesters of the invention mixed with a hydrated transition metal or metalloid salt of a strong acid, and a polymer having a Tg less than 19° C. and being of no or slight acidity (E-1 through E-14) were effective at binding (low retransfer numbers) the, pendant basic dye (Dye 3) whereas the control receiver element described in J05-238174 (C-4) was not (high retransfer numbers).

For the cationic dye precursor (Dye 4), the retransfer density values summarized in Table 6 are unreliable because the unprotonated (unbound) dye is nearly colorless. Based on the % change after HCl fuming data shown in Table 6, highly sulfonated polyesters of the invention mixed with a hydrated transition metal or metalloid salt of a strong acid, and a polymer having a Tg less than 19° C. and being of no or slight acidity (E-1 through E-14) were effective at protonating (binding) the cationic dye precursor (Dye 4, low % change values) whereas the control receiver element described in J05-238174 (C-2) was not (high % change values).

The invention has been described in detail with particular reference to preferred embodiments thereof, but it will be understood that variations and modifications can be effected within the spirit and scope of the invention.

What is claimed is:

1. A thermal dye transfer assemblage comprising:

(a) a dye-donor element comprising a support having thereon a dye layer comprising a dye dispersed in a polymeric binder, said dye being:

I) an electrically neutral, deprotonated, delocalized cationic dye precursor,

II) a pendant basic dye of the formula D-(L-E)$_m$ wherein D represents the residue of a dye, L represents a linking group, E represents a moiety with basic properties and m is an integer of 1–3; or III) a cationic dye precursor having the following structure:

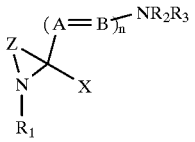

wherein:

$R_1$, $R_2$ and $R_3$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

A and B each independently represents N or CR and may be part of an aromatic or heteroaromatic ring system;

X represents —OR, —N(R)$_2$, —NRCOR, —NRSO$_2$R, —SR, —SO$_2$R, —S(O)R, —O$_2$CR, —NRCON(R)$_2$, —OCON(R)$_2$, —SO$_2$N(R)$_2$ or —NRCOOR; wherein each R independently represents H or $R_1$;

Z represents the atoms necessary to complete a 5- or 6-membered heterocyclic ring which may optionally be fused with other carbo- or heterocyclic rings;

n represents an integer of from 1–5;

X and $R_1$ may be combined to form a 5–7 membered ring; and;

$R_2$ and $R_3$ may be combined together or independently combined with A or B to form a 5–7 membered ring; and (b) a dye-receiving element comprising a support having thereon a polymeric dye image-receiving layer, the dye-receiving element being in a superposed relationship with the dye-donor element so that the dye layer is in contact with the dye image-receiving layer, the dye image-receiving layer comprising a mixture of i) a polymer having a Tg of less than about 19° C. and having no or only slight acidity;

ii) a sulfonated polyester; and iii) a hydrated transition metal or metalloid salt of a strong acid.

2. The assemblage of claim 1 wherein said polymer having a Tg of less than about 19° C. is an acrylic polymer, a styrene polymer or a vinyl polymer.

3. The assemblage of claim 1 wherein said deprotonated, delocalized cationic dye precursor has the following formula:

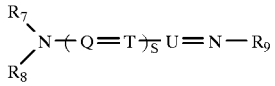

wherein:

Q, T and U form a conjugated link between nitrogen atoms selected from CH, C-alkyl, N, or a combination thereof, the conjugated link optionally forming part of an aromatic or heterocyclic ring;

$R_7$ represents H or a substituted or unsubstituted alkyl group from about 1 to about 10 carbon atoms;

$R_8$ and $R_9$ each individually represents H or a substituted or unsubstituted phenyl or a substituted or unsubstituted alkyl group from about 1 to about 10 carbon atoms; and s is 0 to 11.

4. The assemblage of claim 1 wherein said cationic dye precursor has the following formula:

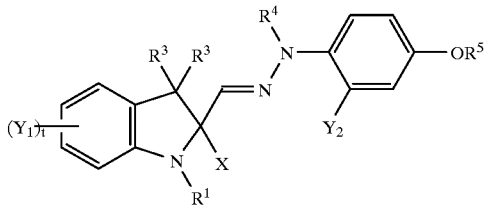

wherein:

$R^1$, $R^2$, $R^3$, $R^4$ and $R^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —N(R)$_2$, —NRCOR, —NRSO$_2$R, —SR, —SO$_2$R, —S(O)R, —O$_2$CR, —NRCON(R)$_2$, —OCON(R)$_2$, —SO$_2$N(R)$_2$ or —NRCOOR; wherein each R independently represents H or $R^1$;

$Y_1$ and $Y_2$ each independently represents R, halogen, CN, alkoxy, aryloxy, alkylthio, arylthio, alkoxycarbonyl, aryloxycarbonyl, acylamino, sulfonylamino, nitro, alkylsulfonyl, arylsulfonyl or thiocyano;

t represents an integer of from 1–4;

X and $R^1$ may be combined together with the atoms to which they are attached to form a 5–7 membered ring;

any two of $Y_1$ may be combined to form additional fused rings; and $R^2$ and $R^3$ may be combined together to form a 5–7 membered ring.

5. The assemblage of claim 1 wherein said sulfonated polyester has the formula:

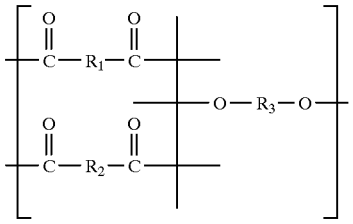

wherein $R_1$ is an aliphatic, cycloaliphatic or aromatic linkage derived from an acid and comprises from 0 to 30 mole percent of the polymer;

$R_2$ is a sulphonated linkage derived from an acid and comprises from 20 to 50 mole percent of the polyester; and $R_3$ is an aliphatic, fatty acid dimer, cycloaliphatic, glycolic, or polymeric linkage derived from prepolymer diols; and comprises 50 mole percent of the polyester.

6. The assemblage of claim 5 wherein said sulfonated polyester is present in said dye image-receiving layer in an amount of from about 0.02 to about 5.0 g/m$^2$.

7. The assemblage of claim 1 wherein said hydrated transition metal or metalloid salt of a strong acid is aluminum sulfate.

8. A process of forming a dye transfer image comprising imagewise-heating a dye-donor element comprising a support having thereon a dye layer comprising a dye dispersed in a polymeric binder, and imagewise transferring said dye to a dye-receiving element to form said dye transfer image, said dye-receiving element comprising a support having thereon a polymeric dye image-receiving layer, said dye-donor element comprising a support having thereon a dye layer comprising a dye dispersed in a polymeric binder, said dye being:

I) an electrically neutral, deprotonated, delocalized cationic dye precursor;

II) a pendant basic dye of the formula D-(L-E)$_m$ wherein D represents the residue of a dye, L represents a linking group, E represents a moiety with basic properties and m is an integer of 1–3; or III) a cationic dye precursor having the following structure:

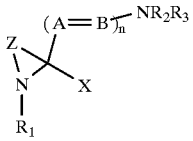

wherein:

$R_1$, $R_2$ and $R_3$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

A and B each independently represents N or CR and may be part of an aromatic or heteroaromatic ring system;

X represents —OR, —N(R)$_2$, —NRCOR, —NRSO$_2$R, —SR, —SO$_2$R, —S(O)R, —O$_2$CR, —NRCON(R)$_2$, —OCON(R)$_2$, —SO$_2$N(R)$_2$ or —NRCOOR; wherein each R independently represents H or $R_1$;

Z represents the atoms necessary to complete a 5- or 6-membered heterocyclic ring which may optionally be fused with other carbo- or heterocyclic rings;

n represents an integer of from 1–5;

X and $R_1$ may be combined to form a 5–7 membered ring; and;

$R_2$ and $R_3$ may be combined together or independently combined with A or B to form a 5–7 membered ring; and said dye image-receiving layer comprising a mixture of i) a polymer having a Tg of less than about 19° C. and having no or only slight acidity;

ii) a sulfonated polyester; and iii) a hydrated transition metal or metalloid salt of a strong acid.

9. The process of claim 8 wherein said polymer having a Tg of less than about 19° C. is an acrylic polymer, a styrene polymer or a vinyl polymer.

10. The process of claim 8 wherein said deprotonated, delocalized cationic dye precursor has the following formula:

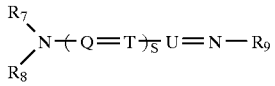

wherein:

Q, T and U form a conjugated link between nitrogen atoms selected fro m CH, C-alkyl, N, or a combination thereof, the conjugated link optionally forming part of an aromatic or heterocyclic ring;

$R_7$ represents H or a substituted or unsubstituted alkyl group from about 1 to about 10 carbon atoms;

$R_8$ and $R_9$ each individually represents H or a substituted or unsubstituted phenyl or a substituted or unsubstituted alkyl group from about 1 to about 10 carbon atoms; and s is 0 to 11.

11. The process of claim 8 wherein said cationic dye precursor has the following formula:

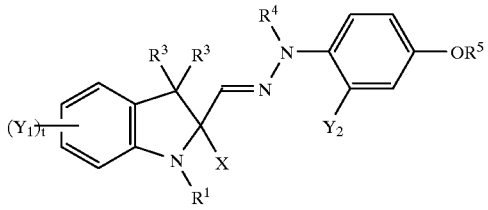

wherein:

$R^1$, $R^2$, $R^3$, $R^4$ and $R^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —N(R)$_2$, —NRCOR, —NRSO$_2$R, —SR, —SO$_2$R, —S(O)R, —O$_2$CR, —NRCON(R)$_2$, —OCON(R)$_2$, —SO$_2$N(R)$_2$ or —NRCOOR; wherein each R independently represents H or R$^1$;

Y$_1$ and Y$_2$ each independently represents R, halogen, CN, alkoxy, aryloxy, alkylthio, arylthio, alkoxycarbonyl, aryloxycarbonyl, acylamino, sulfonylamino, nitro, alkylsulfonyl, arylsulfonyl or thiocyano;

t represents an integer of from 1–4;

X and R$^1$ may be combined together with the atoms to which they are attached to form a 5–7 membered ring;

any two of Y$_1$ may be combined to form additional fused rings; and

R$^2$ and R$^3$ may be combined together to form a 5–7 membered ring.

12. The process of claim 8 wherein said sulfonated polyester the formula:

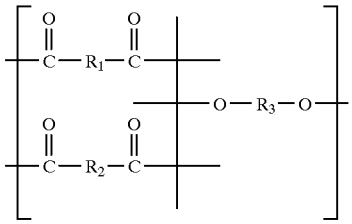

wherein

R$_1$ is an aliphatic, cycloaliphatic or aromatic linkage derived from an acid and comprises from 0 to 30 mole percent of the polymer;

R$_2$ is a sulphonated linkage derived from an acid and comprises from 20 to 50 mole percent of the polyester; and R$_3$ is an aliphatic, fatty acid dimer, cycloaliphatic, glycolic, or polymeric linkage derived from prepolymer diols; and comprises 50 mole percent of the polyester.

13. The process of claim 8 wherein said sulfonated polyester is present in said dye image-receiving layer in an amount of from about 0.02 to about 5.0 g/m$^2$.

14. The process of claim 8 wherein said hydrated transition metal or metalloid salt of a strong acid is aluminum sulfate.

* * * * *